US007036474B2

(12) United States Patent
Axmacher et al.

(10) Patent No.: US 7,036,474 B2
(45) Date of Patent: May 2, 2006

(54) CONTROL DEVICE AND METHOD FOR ADJUSTING THE ANGULAR VELOCITY RATIO BETWEEN A CAMSHAFT AND A CRANKSHAFT

(75) Inventors: Detlef Axmacher, Iserlohn (DE); Massimiliano Gasparro, Halver (DE); Dirk Neubauer, Nachrodt-Wiblingwerde (DE); Frank Pachan, Dortmund (DE); Lars Pfützenreuter, Werdohl (DE); Markus Wilke, Nurtingen (DE)

(73) Assignee: AFT Atlas Fahrzeugtechnik GmbH, Werdohl (DE)

( * ) Notice: Subject to any disclaimer, the term of this patent is extended or adjusted under 35 U.S.C. 154(b) by 0 days.

(21) Appl. No.: 11/079,044

(22) Filed: Mar. 14, 2005

(65) Prior Publication Data

US 2005/0183681 A1 Aug. 25, 2005

Related U.S. Application Data

(63) Continuation of application No. PCT/DE03/02875, filed on Aug. 29, 2003.

(30) Foreign Application Priority Data

Sep. 13, 2002 (DE) ..... 102 42 659

(51) Int. Cl.
*F01L 1/34* (2006.01)

(52) U.S. Cl. ..... 123/90.31; 123/90.15; 123/90.17

(58) Field of Classification Search ..... 123/90.15, 123/90.17, 90.31
See application file for complete search history.

(56) References Cited

U.S. PATENT DOCUMENTS 5,361,736 A * 11/1994 Phoenix et al. ..... 123/90.17

FOREIGN PATENT DOCUMENTS

| | | |
|---|---|---|
| DE | 36 38 527 | 5/1988 |
| DE | 198 04 942 | 8/1999 |
| DE | 199 10 210 | 9/2000 |
| DE | 100 38 354 | 2/2002 |
| EP | 0 274 019 | 7/1988 |
| FR | 2 814 604 | 3/2002 |

OTHER PUBLICATIONS

Taubitz, DE 19804942 (Translation).*

* cited by examiner

*Primary Examiner*—Thomas Denion
*Assistant Examiner*—Zelalem Eshete
(74) *Attorney, Agent, or Firm*—Volpe and Koenig, P.C.

(57) ABSTRACT

A control device and method for adjusting the angular velocity ratio ($\omega_N(t)/\omega_K(t)$) between a camshaft and a crankshaft is provided. Various control devices and methods for rotating the camshaft relative to the crankshaft provide a drive which may advance and retard the camshaft in comparison to the crankshaft. Previous systems have the disadvantage that either two drives in different directions are necessary for each actuation direction or the drive must have right-handed rotation and left-handed rotation. In the control device and the method according to the invention, the advancing of the camshaft is achieved by a drive in the running direction of the camshaft and the retarding is achieved by a braking device. It has been shown to be especially advantageous if an electric motor in two quadrant mode is used as the drive, which may then also be used as the braking device. Such a control device and method are required for setting the control times in internal combustion engines.

7 Claims, 2 Drawing Sheets

CONTROL DEVICE AND METHOD FOR ADJUSTING THE ANGULAR VELOCITY RATIO BETWEEN A CAMSHAFT AND A CRANKSHAFT

BACKGROUND

The present invention relates to a control device and a method for adjusting the angular velocity ratio ($\omega_N(t)/\omega_K(t)$) between a camshaft and a crankshaft.

In internal combustion engines, the crankshaft drives one or more camshafts via a primary drive, which is implemented as a toothed belt, for example. For this purpose, a cam wheel, via which the primary drive drives the camshaft, is attached to each camshaft. The angular velocity $\omega_K(t)$ of the crankshaft is converted at each instant, whereby the angular velocity of the crankshaft $\omega_K(t)$ can be used in determining the angular velocity of the camshaft $\omega_N(t)$, using $\omega_N(t)=½*\omega_K(t)$. The ratio of the two angular velocities is constant due to this coupling. In most applications, this fixed coupling between camshaft and crankshaft results in a ratio of $(\omega_N(t)/\omega_K(t))=½$.

However, the operating properties of an internal combustion engine may be optimized, particularly in regard to fuel consumption, exhaust gas emission, and smooth running, if the system coupled between the camshaft and crankshaft via the primary drive may be altered.

A control unit for adjusting the rotational angle of a camshaft in relation to the rotational angle of a crankshaft using a wobble plate mechanism is disclosed in DE 100 38 354 A1. In this case, an additional drive also acts on the camshaft via a wobble plate mechanism which is positioned between the cam wheel and the camshaft. This results in the camshaft being able to be adjusted in relation to the crankshaft. The additional drive may act on the camshaft in both directions via the wobble plate mechanism, so that its angular velocity in relation to the camshaft, and therefore the fixed ratio ($\omega_N(t)/\omega_K(t)$), changes.

However, this has the disadvantage that the drive must have right-handed rotation and left-handed rotation, in order to move the wobble plate both in one direction and in the other direction, or two motors which have different rotational directions are necessary. In the event of sudden changeover from one rotational direction to the other rotational direction in order to return the camshaft into the original starting position, for example, all components are strongly loaded and, in addition, in the case of electric motors which have right-handed rotation and left-handed rotation, bridge circuits are then necessary, which require costly power components.

SUMMARY

The objective of the present invention is to specify a simple and cost-effective alternative for adjusting the camshaft in relation to the crankshaft.

This objective is achieved according to the present invention by using an additional drive in one direction that elevates the angular velocity $\omega_N(t)$ of the camshaft and a braking device reduces the angular velocity $\omega_N(t)$ of the camshaft, this additional drive having no influence on the angular velocity of the crankshaft. Due to the additional drive, the camshaft may lead the crankshaft somewhat in relation to the exclusively coupled system of camshaft and crankshaft, correspondingly, the lead is canceled again or the crankshaft is now caused to lead the camshaft by the braking of the camshaft, so that the valves close earlier or later, depending on whether the crankshaft leads the camshaft or the camshaft leads the crankshaft.

The advantages of the present invention are that such a construction is very cost-effective, because the drive only has to have one rotational direction, and therefore controlling it is also very simple. Likewise, a braking device is very simple to construct, independently of whether it is an electromagnetic or mechanical braking device.

Advantageous refinements result from the subclaims. With an electric motor in two quadrant mode, the motor may be used the as the drive device and as the braking device. In one exemplary embodiment in particular, a further, second braking device has been shown to be advantageous in order to reach the desired adjustment positions more rapidly.

BRIEF DESCRIPTION OF THE DRAWINGS

The present invention will be described in greater detail in the following on the basis of exemplary embodiments and the drawing figures.

DETAILED DESCRIPTION OF THE PREFERRED EMBODIMENTS

Figure 1:
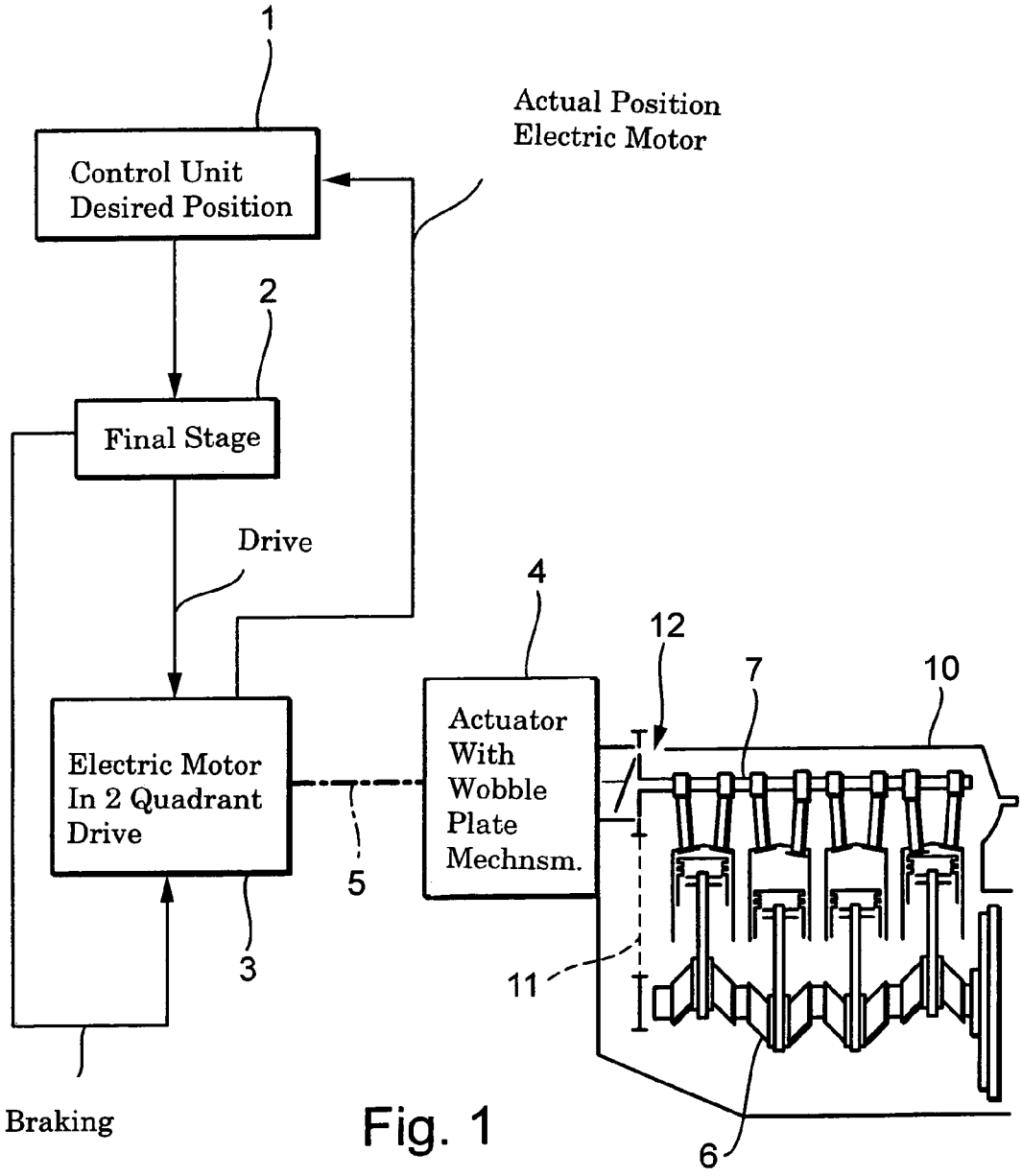
FIG. 1 is a diagram showing a control device having an electric motor in two quadrant mode for driving in one direction and braking the camshaft via the actuator.

FIG. 1 shows a control device 13 having an electric motor 3 in two quadrant mode for driving and braking an actuator 4 having a wobble plate mechanism. This control device 13 comprises a control unit 1, a final stage 2, an electric motor 3 in two quadrant mode, and a driveshaft 5, which connects the electric motor 3 to the actuator 4. The actuator 4 has a wobble plate mechanism, as is disclosed in DE 100 38 354 A1, for example. The position of the camshaft 7 in relation to the crankshaft 6 in the internal combustion engine 10 may be altered using the actuator 4. The camshaft 7 is coupled to the crankshaft 6 via the cam wheel 12 and a primary drive 11. This fixed ratio between the crankshaft 6 and the camshaft 7 may be influenced by the actuator 4, to adapt the control times as a function of the speed, for example, due to which the camshaft 7 may lead or trail the crankshaft 6. The leading of the camshaft 7 is caused in that the electric motor 3 additionally drives the camshaft in the rotational direction via the driveshaft 5 and the actuator 4 having the wobble plate mechanism. The additional drive using electric motor 3 causes the camshaft 7 to rotate more rapidly than would be the case due to the primary drive 11 alone. Through the elevation of the ratio ($\omega_N(t)/\omega_K(t)$) of the angular velocities $\omega_N(t)$, $\omega_K(t)$ of the camshaft 7 and the crankshaft 6, the camshaft 7 leads somewhat, through which the relationship between the camshaft rotational angle and the crankshaft rotational angle also changes. This also means that the camshaft 7 has twisted in relation to the cam wheel 12. Correspondingly, the combustion chambers of the internal combustion engine 10 are opened and closed earlier or later in the operating cycle by the valves as the camshaft 7 rotates. The camshaft 7 leads in relation to the crankshaft 6 due to the additional electric drive 3 until the desired rotational angle relationship has been set and the valves are opened and closed at the desired instant. The twist angle of the shaft is referred to as the rotational angle, the crankshaft rotational angle lying between 0° and 720° as a result of the coupling via the primary drive, while the camshaft rotational angle may reach values from 0° to 360°. Accordingly, by turning off the additional electric drive 3 or also by equalizing it to the angular velocity which results solely from the primary drive, this state may be maintained. In order to return to the starting position, the camshaft 7 is braked by the regenerative braking device of the electric motor 3 via the actuator 4 until it is positioned in the original ratio to the crankshaft 6. In the reverse case, if the crankshaft 6 is to lead the camshaft 7, the camshaft 7 may be braked by the regenerative braking device of the electric motor 3 via the actuator 4 until the desired rotational angle relationship is produced. This state may then be maintained by turning off the braking device 3. In order to return to the starting position, the camshaft 7 is accelerated by the drive function of the electric motor 3 via the actuator 4 until it is set in the original ratio to the crankshaft 6.

In the exemplary embodiment, the angular velocity of the camshaft 7 is reduced using the same electric motor 3 which is also responsible for the drive. However, this motor is then used not as a drive, but rather as a braking device. The electric motor 3 has a controller which allows a two quadrant mode, i.e., using the electric motor 3, a driveshaft 5 may be both driven in one direction and braked. During braking, the electric motor 3 acts as a generator which causes the driveshaft 5 to be braked. This regenerative braking causes the angular velocity of the camshaft 7 to be reduced in the actuator 4 having the wobble plate mechanism. The braking is performed until the desired offset between crankshaft 6 and camshaft 7 is achieved. The angular velocity of the camshaft 7 is then again determined exclusively by the angular velocity of the crankshaft 6, which is transmitted to the cam wheel of the camshaft 7 using primary drive 11. The electric motor 3 is controlled in the two quadrant mode via a controller 1 having setpoint value presets which relate to comparative data of sensors (not shown), for example. This comparative data includes, for example, the current actual values, such as the speed of the electric motor 3 and/or the position of the camshaft 7 and the crankshaft 6. The controller 1 is connected to a final stage 2 which causes the electric motor 3 to exert a driving function or regeneratively brake. This final stage 2 makes the two quadrant mode of the electric motor 3 possible with the aid of a cost-effective half bridge circuit. In order to close the control circuit between the controller 1 and electric motor 3, it is necessary to detect an actual value which describes the status of the system, particularly the electric motor 3, and feed it into the control unit 1.

The electric motor 3 in two quadrant mode is advantageous because only a few power components are necessary for controlling it. In contrast to typical electric motors in four quadrant mode, for example, which have left-handed rotation and right-handed rotation, only one half-bridge circuit is necessary for control here. Such a circuit is more cost-effective, space-saving, and less susceptible to breakdown. The primary statement in this exemplary embodiment is that to adjust the offset between crankshaft and camshaft, an electric motor which has a drive function in one direction and a braking function may be used. These two functions: driving and braking, allow the camshaft to lead and/or trail in relation to the crankshaft, so that the fixed coupling factor between crankshaft and camshaft may be altered. The regenerative braking of the electric motor 3 may be used so that the increase of the angular velocity of the camshaft 7 may be ended more rapidly, so that the camshaft is brought back into the basic setting in relation to the crankshaft, or even to achieve a negative offset between camshaft and crankshaft.

Likewise, other variations which have any arbitrary drive in one direction and a braking device are also conceivable, the drive not only able to be of electrical origin, but rather all other types of drive which achieve the same result also being able to be used. The braking device may also be constructed independently from the drive and other types of braking devices which cause braking may be used. The position of the braking device is unimportant, it may act on the camshaft either directly or indirectly via the wobble plate mechanism.

Figure 2:
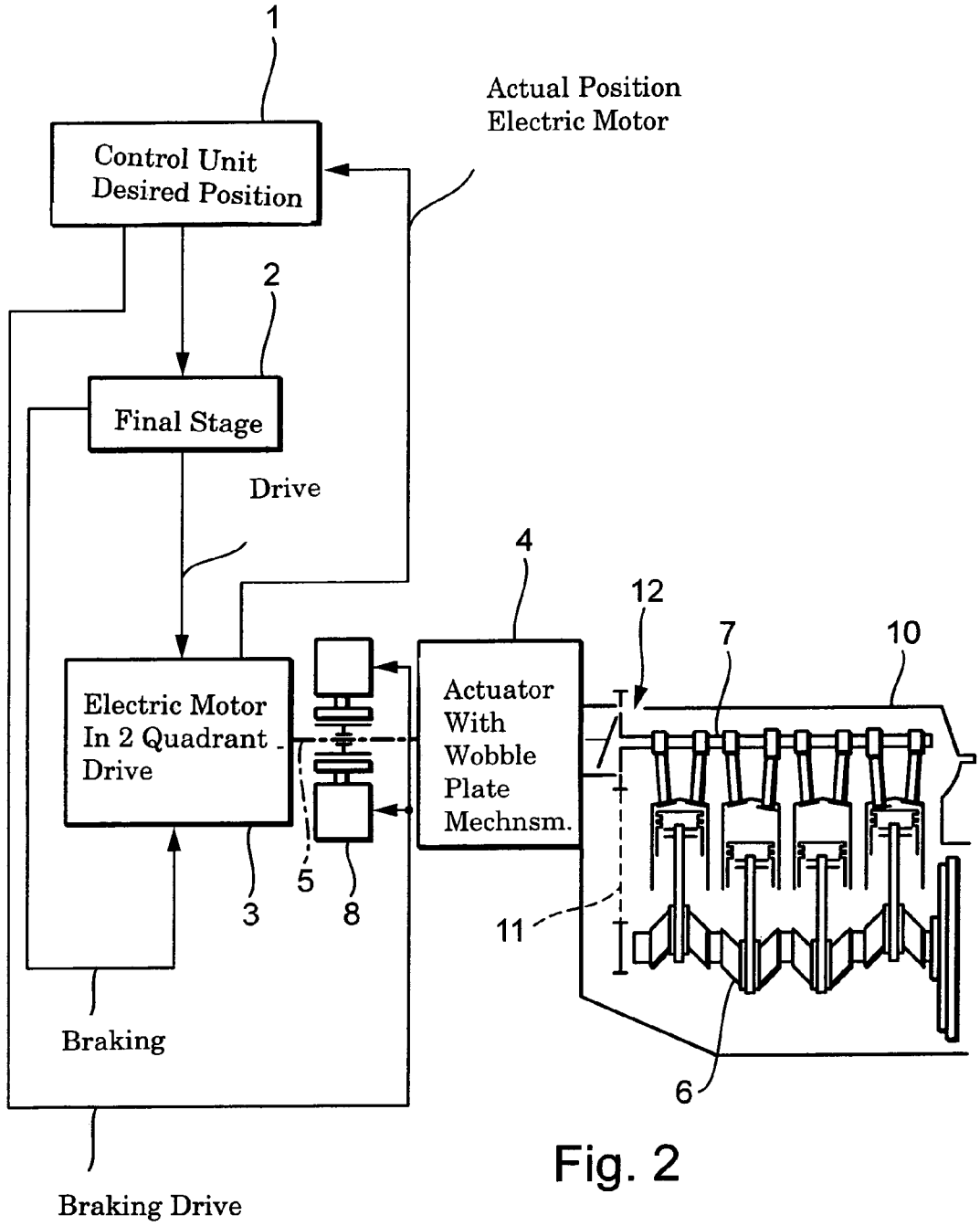
FIG. 2 is a diagram that shows a control device having an electric motor in two quadrant mode for driving and braking the camshaft via the actuator having an additional braking device.

FIG. 2 shows a control device 13 having an electric motor 3 in two quadrant mode for driving and braking the actuator 4 having an additional braking device 8. The internal combustion engine 10 contains the crankshaft 6, which drives the cam wheel 12 of the camshaft 7 via a primary drive 11. The system is coupled between crankshaft 6 and cam wheel 12. This means that the transmission of the rotational angle of the crankshaft 6 is set permanently, 720° crankshaft rotational angle being converted into 360° cam wheel rotational angle. An actuator 4, using its wobble plate mechanism, for example, causes the camshaft 7 to be able to be twisted in relation to the cam wheel 12. Correspondingly, the camshaft 7 may lead or trail in relation to the crankshaft 6, through which the combustion chambers of the internal combustion engine 10 are opened and closed earlier or later in turn by the valves as the camshaft 7 rotates in the operating cycle. The actuator 4 is connected to a driveshaft 5 which is driven by an electric motor 3. The electric motor 3 preferably operates in two quadrant mode, i.e., using it the driveshaft 5 may be driven in one direction and braked. Furthermore, an additional braking device 8 is located between the electric motor 3 and the camshaft 7 in this exemplary embodiment. This braking device 8 is preferably attached in such a way that it may act on the driveshaft 5 in order to reduce its angular velocity as rapidly as possible. The braking device 8 may also be implemented mechanically, for example, particularly hydraulically or pneumatically. This brake 8 is controlled via a controller 1 which operates using a setpoint value preset to which the controller is to be set, for example. A final stage 2, which in turn either drives, turns off, or brakes the electric motor, is also controlled using this controller 1.

In order to be able to adjust camshafts rapidly in both directions, the properties of an electric motor 3 in two quadrant mode and, in addition, the additional braking device are used. This means that they act as a drive on the camshaft in one adjustment direction and act as a brake in the other adjustment direction. As shown in FIG. 2, the additional braking devices 8 cause the adjustment velocity to be able to be increased in that more rapid braking occurs because the regenerative braking of the electric motor supports it. Furthermore, the braking device 8 may be attached externally or even as a component of the electric motor 3 or the actuator 4 or act directly on the camshaft 7. The type and position of the braking device 8 depends on the local conditions, the braking device may be controlled both internally via the controller 1 of the electric motor 3 or even via other external devices.

The invention claimed is:

1. Control device (13) for adjusting an angular velocity ratio ($\omega_N(t)/\omega_K(t)$) between a camshaft (7) and a crankshaft (6), the control device comprising an actuator (4) which rotates the camshaft (7), at least one drive (3), which elevates an angular velocity $\omega_N(t)$ of the camshaft (7) via the actuator (4), and at least one additional braking device (8), which reduces the angular velocity $\omega_N(t)$ of the camshaft (7).

2. Control device (13) according to claim 1, wherein the control device (13) includes an electric motor (3) which operates both as a drive and as a braking device in a two quadrant mode.

3. Control device (13) according to claim 1, further comprising a driveshaft (5) connected between the drive (3) and the actuator (4), and a second braking device (8) is attached in proximity to the driveshaft in order to brake it.

4. Control device (13) according to claim 1, wherein the actuator includes a wobble plate mechanism.

5. Method for adjusting an angular velocity ratio ($\omega_N(t)/\omega_K(t)$) between a camshaft (7) and a crankshaft (6), comprising accelerating the camshaft (7) in a running direction by a drive (3) to elevate the ratio ($\omega_N(t)/\omega_K(t)$), and braking the camshaft using an additional braking device (8) to reduce the angular velocity ratio ($\omega_N(t)/\omega_K(t)$).

6. Method according to claim 5, further comprising operating an electric motor (3) in a two quadrant mode as the additional drive for both driving and braking the camshaft.

7. A method of using a control device (13) according to claim 1, wherein control times of an internal combustion engine (10) are adapted to operating conditions using the control device.

* * * * *